US012228016B2

(12) United States Patent
Hay

(10) Patent No.: US 12,228,016 B2
(45) **Date of Patent: *Feb. 18, 2025**

(54) TAPERED STRING PULSE POWER ROCK EXCAVATION SYSTEM

(71) Applicant: Halliburton Energy Services, Inc., Houston, TX (US)

(72) Inventor: Richard Thomas Hay, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/403,489

(22) Filed: Jan. 3, 2024

(65) Prior Publication Data

US 2024/0133271 A1 Apr. 25, 2024

Related U.S. Application Data

(63) Continuation of application No. 17/547,399, filed on Dec. 10, 2021, now Pat. No. 11,898,420.

(51) Int. Cl.
*E21B 41/00* (2006.01)
*E21B 10/62* (2006.01)
(Continued)

(52) U.S. Cl.
CPC ..... *E21B 41/0085* (2013.01); *E21B 10/62* (2013.01); *E21B 17/003* (2013.01); *E21B 17/028* (2013.01); *E21B 47/12* (2013.01)

(58) Field of Classification Search
CPC ..... E21B 17/028; E21B 17/003; E21B 10/62; E21B 47/12
See application file for complete search history.

(56) References Cited

U.S. PATENT DOCUMENTS 4,844,182 A 7/1989 Tolle
10,718,163 B2 7/2020 Gilbrech
(Continued)

FOREIGN PATENT DOCUMENTS

EP 3117064 1/2017
WO 2021007335 1/2021
WO 2023107116 6/2023

OTHER PUBLICATIONS

"PCT Application No. PCT/US2021/062756, International Search Report and Written Opinion", Aug. 30, 2022, 9 pages.
(Continued)

*Primary Examiner* — Caroline N Butcher
(74) *Attorney, Agent, or Firm* — DeLizio, Peacock, Lewin & Guerra LLP

(57) ABSTRACT

Systems and methods for drilling a wellbore include delivering electrical energy to a downhole end of the wellbore. A tapered drill string, with larger drill pipes connected in an up-hole portion with a turbine and an electrical generator and a smaller drill pipes coupled in downhole portion may be used to deliver the electrical power. A turbine and generator may be sufficiently sized to harvest the necessary hydraulic energy and safely operated in a subterranean environment. A lower portion system carried by the downhole portion of the drill string is electrically coupled to the generator through the downhole portion of the drill string to utilize the electric power provided by the electrical generator.

20 Claims, 3 Drawing Sheets

(51) Int. Cl.

| | |
|---|---|
| ***E21B 17/00*** | (2006.01) |
| ***E21B 17/02*** | (2006.01) |
| ***E21B 47/12*** | (2012.01) |

(56) References Cited

U.S. PATENT DOCUMENTS

| | | | | |
|---|---|---|---|---|
| 2010/0101072 | A1 | 4/2010 | Cook et al. | |
| 2010/0300685 | A1* | 12/2010 | Del Campo | E21B 17/003 166/254.2 |
| 2018/0163478 | A1* | 6/2018 | Dirksen | E21B 19/22 |
| 2018/0209216 | A1 | 7/2018 | Gilbrech | |
| 2019/0330977 | A1 | 10/2019 | Hay | |
| 2023/0184043 | A1 | 6/2023 | Hay | |
| 2023/0316419 | A1 | 10/2023 | Bishnoi et al. | |

OTHER PUBLICATIONS

"U.S. Appl. No. 17/547,399, Final Office Action", Jul. 27, 2023, 15 pages.

"U.S. Appl. No. 17/547,399, Non-Final Office Action", Feb. 16, 2023, 15 pages.

* cited by examiner

TAPERED STRING PULSE POWER ROCK EXCAVATION SYSTEM

BACKGROUND

The present disclosure relates generally to tools and methods for forming a wellbore in the Earth, e.g., for producing hydrocarbons and other subterranean fluids to the surface. More particularly, embodiments of the disclosure include a drilling system arranged for safely delivering high-voltage electrical power to an electrode or electrodes at a downhole end of the wellbore.

To produce hydrocarbons from a subterranean formation, wellbores may be drilled that penetrate hydrocarbon-containing portions of the subterranean formation. In traditional drilling systems, rock destruction is carried out via rotary power provided to the drill string by rotating the drill string at the surface using a rotary table or a top drive or may be provided from a down hole mud motor powered by mud circulating through the wellbore. Through these modes of power provision, traditional bits such as tri-cone, polycrystalline diamond compact ("PDC"), and diamond bits are operated at varying speeds and torques.

When drilling in rock formations, frictional forces between the drill bit and the rock will vary depending on the hardness, porosity or other properties of the rock. The variation in frictional forces may result in vibrations, stick-slip and other difficulties resulting in low rates of penetration, damage to the drilling equipment and other technical obstacles.

One method that has been employed to address some of these technical obstacles is electro-pulse drilling in which high electric potential is repeatedly applied across electrodes carried at the distal end of a drill string. In some methods, there is little or no drill string rotation while the electrodes excavate the wellbore, and in other methods mechanical cutters may be rotated to supplement the electrical energy applied by the electrodes. The systems generate multiple sparks per second using a specified excitation current profile that causes a transient spark to form and arc through the most conducting portion of the wellbore floor. The arc causes that portion of the borehole floor penetrated by the arc to disintegrate or fragment and be swept away by the flow of drilling fluid.

Large turbines and generators have been employed at the surface to produce sufficient electrical power for these systems to operate effectively. However, these generators can be hazardous to operators at the surface.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes systems and methods for drilling a wellbore by delivering electrical energy to a downhole end of the wellbore. Systems described herein include a tapered drill string with larger drill pipes connected in an up-hole portion and a smaller drill pipes coupled in downhole portion. A turbine and generator may be coupled in the larger up-hole portion where these components may be sufficiently sized to harvest the necessary hydraulic energy and safely operated in a subterranean environment. An electrode or electrodes carried at the smaller downhole end is electrically coupled to the generator through the drill string. It has been determined that for pulse-power drilling systems, generating electrical power downhole may be safer than generating electrical power at the surface where operators may be exposed to electrical cables and high voltage equipment. Electrical power may be more safely generated downhole with an electrical generator coupled in a bottom hole assembly (BHA), for example, but it may be difficult to extract sufficient power from mud flow through the BHA. The systems and methods described herein permit equipment to be appropriately sized to extract sufficient power from the flow of drilling fluids while being operated in a downhole environment.

Figure 1:
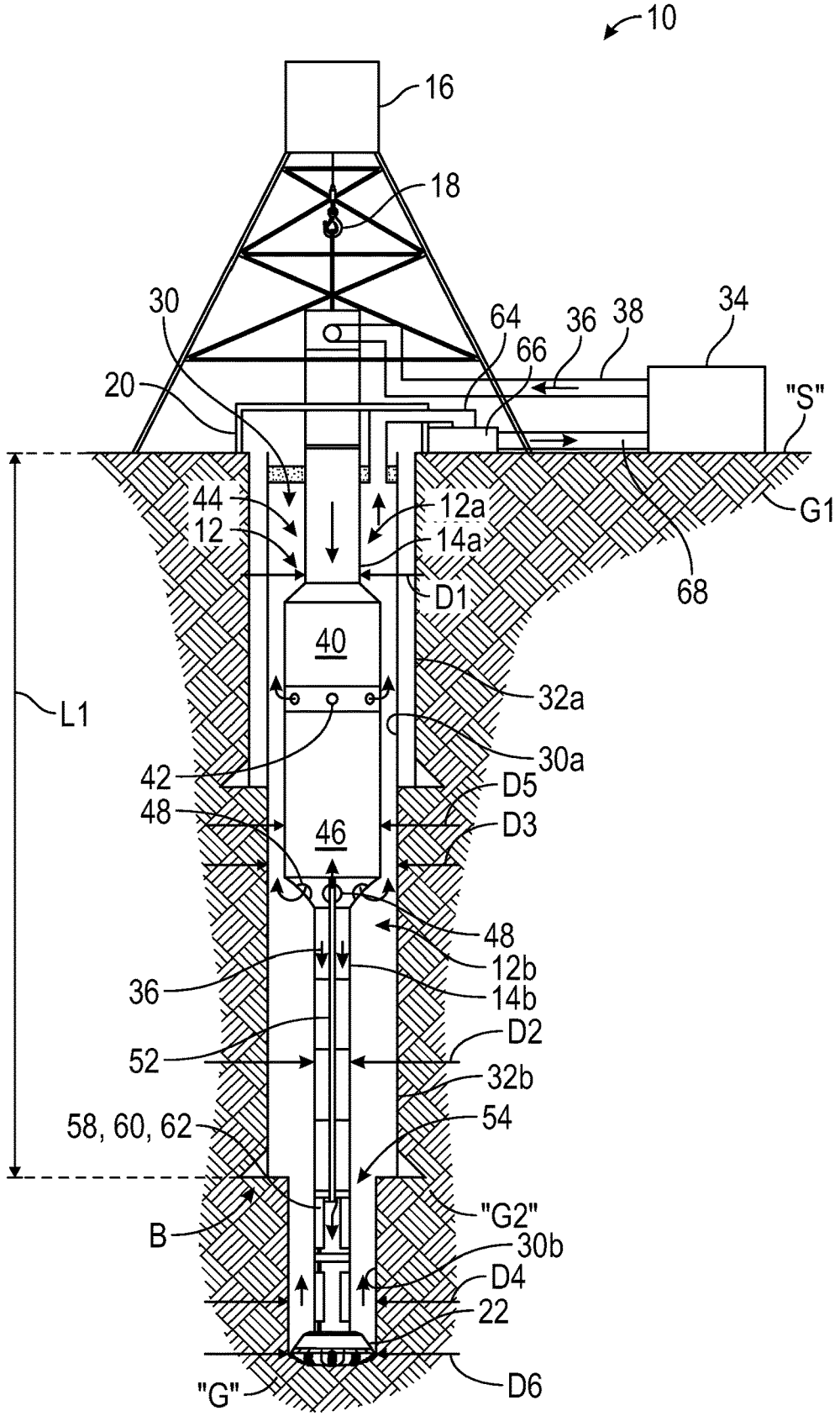
FIG. 1 is a partial, cross-sectional side view of a pulse-power wellbore excavation system illustrating a tapered drill string having power generation equipment coupled in an upper portion thereof and an electrode coupled to a lower portion thereof that has a relatively small diameter with respect to the upper portion of the drill string in accordance with aspects of the present disclosure.

FIG. 1 illustrates a wellbore excavation system 10 with a tapered drill string 12 in accordance with example embodiments of the present disclosure. The drill string 12 may include, but is not limited to, segments drill pipe and coiled tubing, as generally known to those skilled in the art. As illustrated in FIG. 1, the tapered drill string 12 includes an up-hole portion 12*a* constructed of a first plurality of drill pipes 14*a* having a first diameter D1 and a downhole portion 12*b* constructed of a second plurality drill pipes 14*b* having a second diameter D2 that is smaller than the first diameter D1. Drill pipes 14*a* may be referred herein as "larger" drill pipes and drill pipes 14*b* may be referred to as "smaller" drill pipes. Generally, the larger drill pipes 14*a* will have a larger inner diameter that can facilitate a larger mass flow of drilling fluid at a particular circulating pressure than a smaller inner diameter of the smaller drill pipes 14*b*. This larger mass flow of drilling fluid facilitates the production of electrical power and the cooling of power conversion equipment. A smaller mass flow may be established through the smaller drill pipes 14*b* of the downhole portion 12*b* to effectively support the excavation at the downhole end of the drill string 12. As described in greater detail below, the tapered drill string 12 may be employed to safely and effectively conduct pulse-powered drilling operations.

The wellbore drilling system 10 includes a derrick 16 having a traveling block 18 for raising and lowering the drill string 12 and, in some embodiments, an optional rotary table 20 may be provided for rotating the drill string 12. Pressure may be applied to an electrode 22 coupled to downhole end of the drill string 12 to advance the drill string 12 and the electrode to create wellbore 30. As electrode 22 is advanced, it penetrates geologic formation "G" to extend wellbore 30. In some embodiments, the electrode 22 is held rotationally stationary as it is advanced through the geologic formation "G." While wellbore 30 is illustrated extending from a terrestrial surface location "S," the principles described herein are equally applicable to subsea drilling operations that employ floating or sea-based platforms and rigs, without departing from the scope of the disclosure.

As illustrated, the wellbore 30 includes an up-hole portion 30*a* extending from the surface location "S" and a downhole portion 30*b* extending from the up-hole portion 30*a*. The up-hole portion 30*a* has an up-hole diameter D3 and the downhole portion has a downhole diameter D4 that is smaller than the up-hole diameter D3. The electrode 22 has a nominal diameter for generating the downhole diameter D4. Generally, the up-hole portion 30*a* of the wellbore 30 extends through a first portion G1 of the geologic formation "G" that is closer to the surface location "S" and has a lower compressive strength than a second portion G2 of the geologic formation "G." Because of the fracture gradient, casing strings 32*a*, 32*b* or liners may be installed in the up-hole portion 30*a* of the wellbore 30 to support the first portion G1 of the geologic formation "G." For example, casing string 32*b* may include a 9⅝-inch diameter casing extending the length of installed in the up-hole portion 30*a* of the wellbore 30. Casing string 32*a* may include a larger casing extending around an upper portion of the casing string 32*b*. Also, because of the higher compressive strength of the second portion "G2," the pulse-power rock excavation methods described herein may be more practical methods of fracturing the rock. Although, the wellbore 30 is illustrated in a generally vertical configuration, in other embodiments, a wellbore with any other geometry, e.g., deviated, slanted, curved and/or entirely vertical, may employ the systems and methods described herein without departing from the scope of the disclosure.

The wellbore excavation system 10 further includes a pump 34 (e.g., a mud pump) that circulates drilling fluid 36 through a feed pipe 38 to the up-hole portion 12*a* of the drill string 12. The drilling fluid 36 is conveyed downhole through the larger drill pipes 14*a* to a mud powered turbine 40 connected in the up-hole portion 12*a* of the drill string 12. The turbine 40 contains blades (not shown) that rotate when presented with the drilling fluid 36 under pressure from the pump 34. The relatively large up-hole diameter D3 permits the turbine blades to be sufficiently sized to extract sufficient energy from the drilling fluid 36 to create the electrical energy for fragmenting the second portion G2 of the geologic formation "G." The relatively large diameter D1 of the drill pipes 14*a* permit a sufficient mass flow of the drilling fluid 36 to power the turbine 40. A portion of the drilling fluid 36 may exit the interior of the drill string 14 thorough optional partial flow return ports 42 defined below the turbine 40 into the annulus 44. The portion of the drilling fluid 36 exiting through the flow return ports 42 returns to the surface location "S" through an annulus 44 defined between the drill string 12 and the casing string 30*b*. This returning flow allows for greater cooling for the turbine 40.

The turbine 40 provides rotary power to an electrical generator 46, which converts the rotary power to electrical power. The turbine 40 and the electrical generator 46 exhibit a diameter D5, which may define a largest or nominal diameter of the upper portion 212*a* of the drill string 212. The electrical generator 46 is cooled by a portion of the drilling fluid 36 exiting the drill string 12 through relatively large return ports 48 defined below the electrical generator 46, and a remaining portion of the drilling fluid 36 continues downward through the downhole portion 12*b* of the drill string 12. The electrical power generated by the electrical generator 46 is transmitted through the downhole portion 12*b* through one or more electrically insulated conductors 52. The insulated conductors 52 may include solid metal rods or a chain of electrically connected solid metal rods or insulated wire or electrically connected segments of insulated electrical wire electrically connected to the output of the electric generator 46 extending through each of the drill pipes 14*b* to a bottom hole assembly (BHA) 54. In other embodiments, the conductors 52 may include a first conductor 52 constructed of a conductive material layered between a dielectric layer and an insulating material affixed to the drill pipes 14*b*, and the drill pipes 14*b* themselves may operate as a second conductor 52. The second electrical conductor 52 completes the conveyance of electrical to the lower BHA 54. In other embodiments, the first and second conductors 52 may both be insulated conductors extending through an interior channel defined through the drill pipes 14*b* distinct from the drilling fluid 36. This arrangement may provide additional safety for the transmission of power along the lower portion 12*b* of the drill string 12.

The BHA 54 includes the electrode 22 and generally electrically couples the electrode 22 with the electrical conductors 52. The electrode 22 defines a nominal diameter D6, which is appropriate for excavating the downhole portion 30*b* of the wellbore 30 and which may be the largest diameter component of the lower portion 12*b* of the drill string 12. The BHA 54 also includes a charging capacitor bank 58, switches 60 and step-up transformers 62 between the electrical conductors 54 and the electrode 22. The placement of the step-up transformers 62 in the BHA 54 permits a lower voltage to be transmitted through the electrical conductors 52, and thereby avoid any dielectric breakdown of the inner conductor insulation that may occur from higher voltages and current surges. In other embodiments (not shown), the step-up transformers 62 and switches 60 may be located adjacent the electrical generator 46 above the downhole portion 12*b* of the drill string 12. In some embodiments, the BHA 54 may further include measurement while drilling (MWD) and logging while drilling (LWD) sensors, a telemetry system, and other drilling equipment that may be needed such as drill collars, stabilizers, jars and other drilling tools.

Drilling fluid 36 circulates through the BHA 54 and is expelled through one or more orifices in the electrode 22. The drilling fluid 36 is then circulated back to the surface location "S" through the annulus 44, cooling the electrode 22 and carrying any fragments of rock dislodged from the geologic formation "G." At the surface location "S," the recirculated or spent drilling fluid 36 exits the annulus 44 and may be conveyed through a flow line 64 to one or more fluid processing unit(s) 66. The fluid processing unit 66 may include a shaker table with one or more screens that filter out the fragments from the drilling fluid 36. The drilling fluid 36 may then be returned to the pump 34 through a flow line 68 and recirculated through the wellbore 30.

Figure 2:
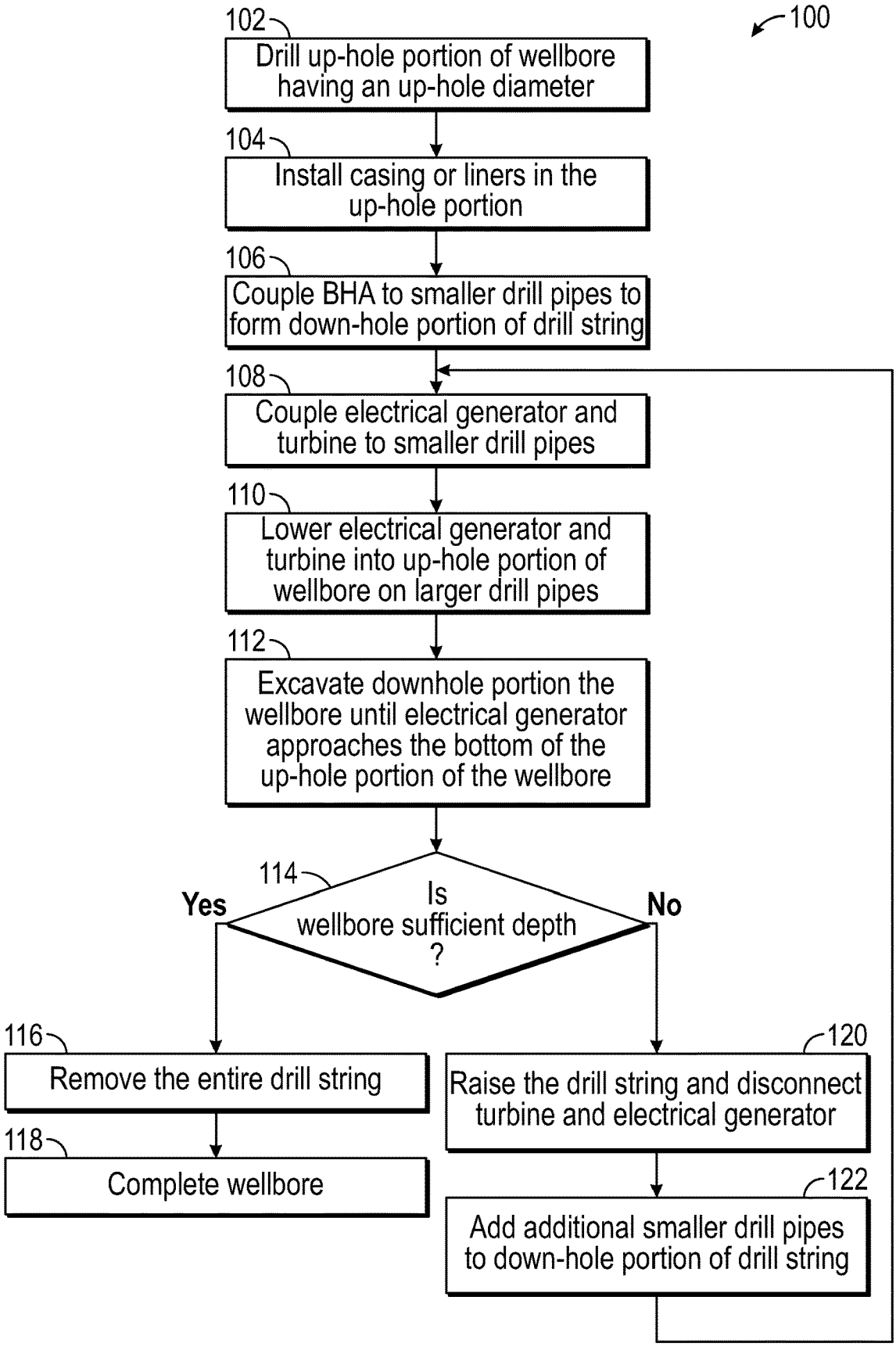
FIG. 2 is a flowchart illustrating a procedure for forming a wellbore with the wellbore excavation system of FIG. 1.

Referring to FIG. 2, and with continued reference to FIG. 1, a procedure 100 for forming wellbore 30 is illustrated. Initially at step 102, the up-hole portion 30*a* of the wellbore 30 is drilled by any method including traditional drilling methods. Because the geologic formation "G" near the surface location "S" has a relatively low compressive strength, the up-hole portion 30*a* of the wellbore 30 may be readily drilled exclusively with rotational energy, e.g., without delivering electrical energy to the geologic formation. An enlarged drill bit (not shown) without any electrodes may be mechanically engaged with the geologic formation "G" to form the up-hole portion of the wellbore. Once a desired depth L1 is achieved, the casing strings 32*a* and 32*b* may be installed (step 104) to complete the up-hole portion 30*a*. In some embodiments, step 104 may be omitted, and an operator may trip out the enlarged drill bit after completing step 102 and proceed directly to step 106.

At step 106, the BHA 54 is coupled to a lower end of the smaller drill pipes 14*b* forming the downhole portion 12*b* of the drill string 12, and at step 108 the electrical generator 46 and the turbine 40 are coupled to an upper end of the smaller drill pipes 14*b*. The number of smaller drill pipes 14*b* are limited such that a length of the entire drill string 12 including the electrode 22 and turbine is less than the depth L1 of the up-hole portion of the wellbore 30.

Next, at step 110, the turbine 40, the electrical generator 46 and down-hole portion 12*a* of the drill string 12 are lowered into the wellbore 30 on the larger drill pipes 14*a*. Additional larger drill pipes 14*a* may be added until the turbine 40 and electrical generator 46 moves below the drill floor into the wellbore 30 and electrode 22 engages a bottom "B" of the up-hole portion 30*a* of the wellbore 30. With the electrical generator 46 safely below the drill floor and in the well bore, pulse-power rock excavation may be initiated. At step 112 the downhole portion 30*b* of the wellbore 30 may be excavated. The pump 34 may be activated to circulate the drilling fluid 36 through the turbine 40, which causes the electrical generator 46 to transmit electrical power through the conductors 52 to the BHA 54. The electrical power is delivered to the geologic formation "G" through the electrode 22 to fracture the rock and extend the down-hole portion 30*b* of the wellbore 30. The drill string 12 may be rotated as the drilling fluid 36 is circulated which may accelerate the excavation. The up-hole portion 12*a* of the drill string 12 may be extended by adding additional larger drill pipes 14*a* to advance the electrode 22 through the geologic formation "G." In this manner, the downhole portion 30*b* of the wellbore 30 may be extended approximately the length of the downhole portion of the drill string 12*b* before the electrical generator 46 approaches the bottom "B" of the up-hole portion 30*a* of the wellbore 30. Since the electrical generator 46 may be a have a greater diameter D5 than the diameter D4 of the downhole portion 30*b* of the wellbore 30, drilling may be interrupted.

At decision 114, the depth of the wellbore 30 is evaluated. If the wellbore 30 has reached the intended depth, the procedure 100 advances to step 114 where the entire drill string 12 may be removed from the wellbore 30. The wellbore 30 may then be completed (step 118) by installing production equipment or otherwise prepared for use in any intended purpose. If at decision 114 it is determined that the wellbore 30 has not reached the intended depth, the procedure 100 advances to step 120 where the drill string 12 is raised at least until the electrical generator 46 may be disconnected. The downhole portion 12*b* of the drill string 12 may remain in the wellbore 30 and additional smaller drill pipes 14*b* may be added to extend the downhole portion 12*b* of the drill string 12 (step 122). If conductors 52 are not already incorporated into the smaller drill pipes 14*b*, additional conductors 52 may be installed and electrically coupled to the conductors 52 already electrically coupled the electrode 22. The procedure 100 may then return to step 108 where the electrical generator 46 is coupled to an uppermost smaller drill pipe 14*b* of the extended downhole portion 12*b* of the drill string 12. Steps 108, 110, 112, 120 and 122 may be repeated as many times as necessary to extend the wellbore 30 to a sufficient depth through further excavation of the formation G.

Figure 3:
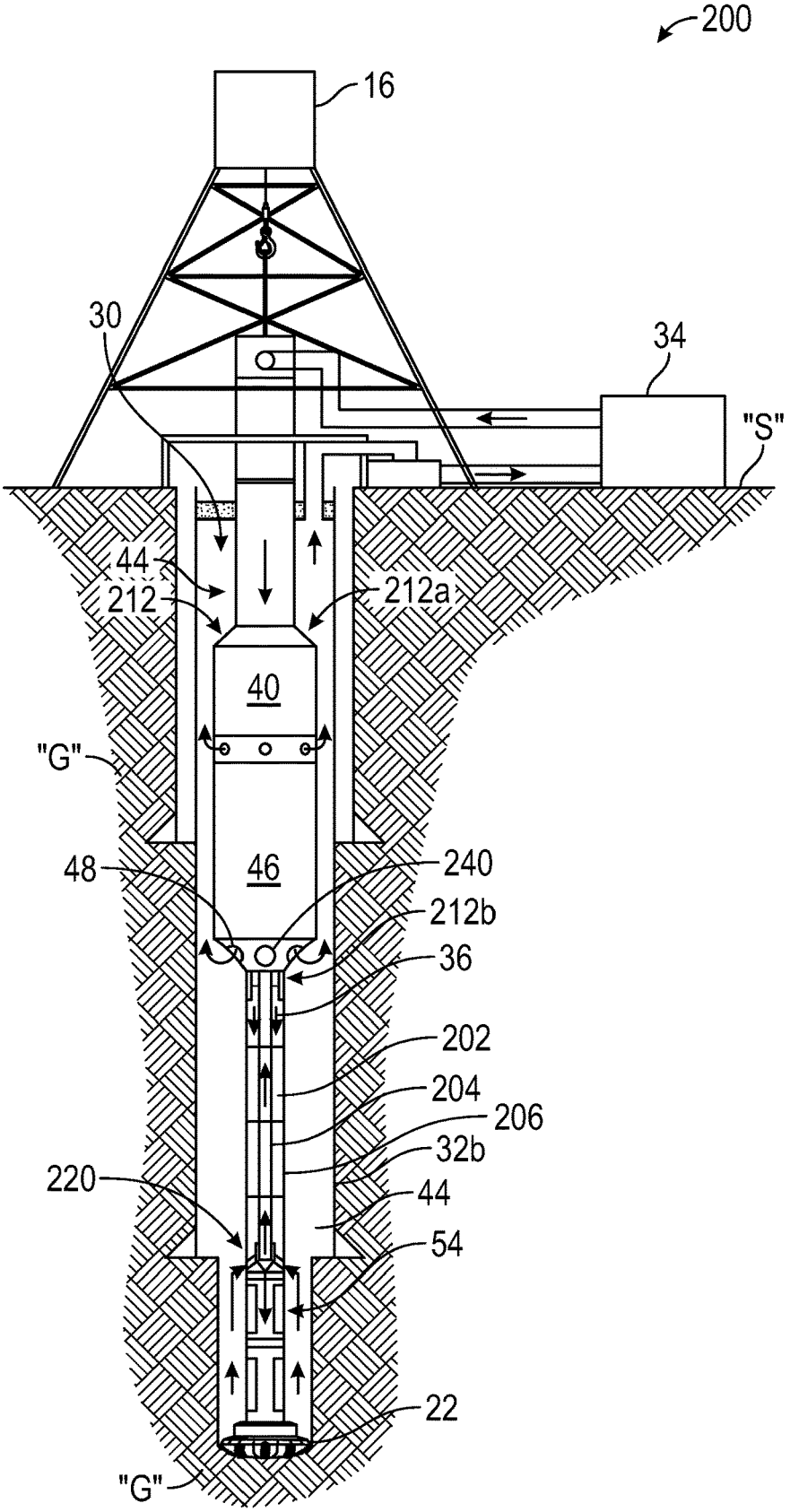
FIG. 3 is a partial, cross-sectional side view of an alternate pulse-power wellbore excavation system in which drilling fluids may be routed in an annulus defined between two nested drill pipes.

Referring now to FIG. 3, an alternate pulse-power wellbore drilling system 200 is illustrated in which drilling fluids 36 may be routed in an annulus 202 defined between two nested smaller drill pipes 204, 206. The system 200 includes a derrick 16, a pump 34 and other equipment at the surface location "S," similar to the system 10 (FIG. 1) described above. A drill string 212 extending into the wellbore 30 may include an upper portion 112*a* including a turbine 40 and an electrical generator 46, similar to the upper portion 12*a* (FIG. 1) of the drill string 12 described above.

A lower portion 112*b* of the drill string 112 includes the nested drill pipes 204, 206 defining the anulus 202 therebetween. The inner drill pipes 204 and the outer drill pipes 206 are electrically insulated from one another to electrically couple the electrical generator 46 to the BHA 54. The nested drill pipes 204, 206 may have a much greater cross-sectional area of electrically conductive material than an insulated cable, and thus the nested drill pipes 204, 206 may exhibit a greater current carrying capacity than an insulated electrically conducting cable. This greater cross-sectional area of electric current carrying material can be used to convey the same power at a lower and safer voltage with less electrical resistant losses, or may allow for greater power delivery than would be possible with a typical electrically insulated cable.

A portion of the drilling fluid 36 passing through the turbine 40 and the generator 46 may be expelled through return ports 48 as described above. A remaining portion of the drilling fluid 36 passing through the turbine 40 and the generator 46 may be routed to the BHA 54 through the annulus 202 defined between the drill pipes 204, 206. After being expelled through the electrode 22, the drilling fluid 36 may re-enter the drill string 212 through a flow diverter 220 defined as a passage extending from the annulus 44 on the outer side of outer drill pipe 206 to an interior of the inner drill pipe 240. The drilling fluid 36 may be carried through inner drill pipes 204 to a return port 240 coupled between the electrical generator 46 and the downhole portion 212*b* of the drill string 212. The drilling fluid 36 may then return to the surface location "S" through the portion of the annulus 44 defined between the casing string 32*b* and the up-hole portion 212*a* of the drill string 212.

One possible advantage of using the nested drill pipes 204, 206 stems from the fact that the annulus 202 between the drill pipes 204, 206 and the bore of the may have a smaller cross-sectional area than an annular space between the downhole portion 212*b* of the drill string and the geologic formation "G" and/or the casing string 32*b*. The relatively small cross-sectional area enables a higher velocity to be imparted to the drilling fluid 36. Thus requiring less drilling fluid flow to entrain the formation debris removed from the excavation and return them to the surface. This drilling fluid 36 flow arrangement facilitated from the larger annulus 44 and larger inner bore of the upper portion drill string 212*a* with the higher upper mass flow of drilling fluid 36 in the upper portion of the drill string 212*a* may permit increased hydro-mechanical power conversion provided by the turbine 40 converting this mechanical power into electrical power by the electrical generator 46. This electrical power may be conveyed to the BHA 54 while the drilling fluid 36 retains sufficient energy to carry formation debris from the electrode 22 back to the surface location "S."

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

The Abstract of the disclosure is solely for providing the United States Patent and Trademark Office and the public at large with a way by which to determine quickly from a cursory reading the nature and gist of technical disclosure, and it represents solely one or more examples.

According to one aspect, the disclosure is directed to a method for forming a wellbore in a geologic formation with a high-voltage drilling system. The method includes (a) forming an up-hole portion of the wellbore to have an up-hole diameter, (b) coupling one or more electrodes to a downhole portion of a drill string, (c) coupling an electrical generator to the downhole portion of the drill string such that the electrical generator is electrically coupled to the one or more electrodes, (d) lowering the electrical generator into the up-hole portion of the wellbore on an up-hole portion of the drill string (e) circulating a wellbore fluid through the wellbore to cause the electrical generator to produce electrical power within the up-hole portion of the wellbore and (f) delivering the electrical power to the one or more electrodes to form a downhole portion form a downhole portion of the wellbore with a downhole diameter less than the up-hole diameter.

In one or more embodiments, the method further includes extending the up-hole portion of the drill string above the electrical generator to advance the one or more electrodes and extend the down-hole portion of the wellbore. The method may further include raising the drill string once the electrical generator approaches a bottom of the up-hole portion of the wellbore, disconnecting the electrical generator, extending the downhole portion of the drill string, recoupling the electrical generator to the drill string and further extending the downhole portion of the wellbore with the extended downhole portion of the drill string.

In some embodiments, forming the up-hole portion of the wellbore includes drilling the up-hole portion of the wellbore by rotating an up-hole drill bit engaged with the geologic formation, the up-hole drill bit having a nominal diameter greater than a nominal diameter of the downhole drill bit. The method may further include operably coupling a turbine to the electrical generator, and wherein circulating the wellbore fluid through the wellbore includes passing the wellbore fluid through the turbine to cause the electrical generator to produce electrical power. The method may also include discharging a portion of the drilling fluid from the up-hole portion of the drill string through a return port disposed below the electrical generator and turbine.

In one or more embodiments, circulating the wellbore fluid through the wellbore includes flowing the wellbore fluid through an annulus defined between nested drill pipes forming the downhole portion of the drill string. Delivering the electrical power to the one or more electrodes may include transmitting the electrical power through a conductor extending through the downhole portion of the drill string to a transformer carried by a bottom hole assembly coupled to the downhole portion of the drill string and stepping up a voltage of the electrical power with the transformer. Transmitting the electrical power through a conductor may include transmitting the transmitting the electrical power through solid metal rods extending through each of a plurality of drill pipes forming a downhole portion of the drill string. The method may further include rotating the drill string while delivering the electrical power to the one or more electrodes.

In another aspect, the disclosure is directed to a high voltage drilling system. The system includes a downhole portion of a drill string including an electrode at a downhole end thereof, the electrode defining a nominal diameter of the downhole portion of the drill string. An electrical conductor extends through the downhole portion of the drill string and is couped to the electrode. An up-hole portion of the drill string is coupled to the downhole portion of the drill string. The up-hole portion of the drill string includes an electrical generator electrically coupled to the electrode through the electrical conductor, wherein the electrical generator defines a nominal up-hole diameter of the uphole portion of the drill string that is greater than the nominal downhole diameter defined by the electrode.

In one or more embodiments, the up-hole portion of the drill string includes one or more larger drill pipes coupled above the electrical generator, the larger drill pipes having a first diameter. The downhole portion of the drill string may includes one or more smaller drill pipes coupled below the electrical generator, the smaller drill pipes having a second diameter less than the first diameter.

In some embodiments, the system further includes a turbine operably coupled to the electrical generator, and wherein at least one of the turbine, electrical generator or the one or more larger drill pipes defines the nominal up-hole diameter. In some embodiments, the system further includes at least one casing string circumscribing the turbine and electrical generator.

In one or more embodiments, the up-hole portion of the drill string includes at least one or more return ports through which a portion of a wellbore fluid flowing within the up-hole portion of the drill string may be discharged to an annulus surrounding the up-hole portion of the drill bit. In some embodiments, the downhole portion of the drill string includes at least one inner drill pipe nested within an outer drill pipe defining an annulus between the inner drill pipe and the outer drill pipe. The electrical conductor may include a solid metal rod extending through the downhole portion of the drill string.

In some embodiments, the system further includes an electrical transformer coupled between the electrical conductor and the at least one electrode, the electrical transformer carried by a bottom hole assembly. The bottom hole assembly further carries a capacitor bank and switches coupled between the electrical conductor and the at least one electrode. In some embodiments, the system further optionally includes a rotary table at a surface location for rotating the drill string.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method for forming a wellbore in a geologic formation with a high-voltage drilling system, the method comprising:

forming an up-hole portion of the wellbore to have an up-hole diameter;

coupling a lower portion system to a downhole portion of a drill string;

coupling an electrical generator that is part of an up-hole portion of the drill string to the downhole portion of the drill string such that the electrical generator is electrically coupled to power the lower portion system;

lowering the electrical generator into the up-hole portion of the wellbore on the up-hole portion of the drill string;

circulating a wellbore fluid through the wellbore to cause the electrical generator to produce electrical power within the up-hole portion of the wellbore; and delivering the electrical power to the lower portion system to form a downhole portion of the wellbore with a downhole diameter less than the up-hole diameter, wherein forming the downhole portion of the wellbore includes maintaining the electrical generator in the up-hole portion of the wellbore producing the electrical power, the electrical generator having a generator diameter that is greater than the downhole diameter of the downhole portion of the wellbore.

2. The method of claim 1, further comprising extending the up-hole portion of the drill string above the electrical generator to advance the lower portion system and extend the downhole portion of the wellbore.

3. The method of claim 2, further comprising raising the drill string once the electrical generator approaches a bottom of the up-hole portion of the wellbore, disconnecting the electrical generator, extending the downhole portion of the drill string, recoupling the electrical generator to the drill string and further extending the downhole portion of the wellbore with the extended downhole portion of the drill string.

4. The method of claim 1, wherein forming the up-hole portion of the wellbore includes drilling the up-hole portion of the wellbore by rotating an up-hole drill bit engaged with the geologic formation, the up-hole drill bit having a nominal diameter greater than a nominal diameter of the downhole drill bit.

5. The method of claim 1, further comprising operably coupling a turbine to the electrical generator, and wherein circulating the wellbore fluid through the wellbore includes passing the wellbore fluid through the turbine to cause the electrical generator to produce electrical power.

6. The method of claim 5, further comprising discharging a portion of the drilling fluid from the up-hole portion of the drill string through a return port disposed below the electrical generator and turbine.

7. The method of claim 1, wherein delivering the electrical power to the lower portion system includes transmitting the electrical power through a conductor extending through the downhole portion of the drill string to a transformer carried by a bottom hole assembly coupled to the downhole portion of the drill string and stepping up a voltage of the electrical power with the transformer.

8. The method of claim 7, wherein transmitting the electrical power through the conductor includes transmitting the electrical power through solid metal rods extending through each of a plurality of drill pipes forming the downhole portion of the drill string.

9. The method of claim 1, further comprising rotating the drill string while delivering the electrical power to the lower portion system.

10. The method of claim 1, wherein the lower portion system includes a bottom hole assembly, the bottom hole assembly including one or more of a measurement while drilling (MWD) system, a drilling system, a logging while drilling (LWD) system, a telemetry system, and a pulse-power system.

11. A high-voltage drilling system for forming a wellbore, comprising:

a downhole portion of a drill string including an electrically powered system at a downhole end thereof;

an electrical conductor extending through the downhole portion of the drill string and coupled to the electrically powered system;

an up-hole portion of the drill string coupled to the downhole portion of the drill string, the up-hole portion of the drill string including an electrical generator electrically coupled to the electrically powered system through the electrical conductor, wherein the electrical generator is configured to produce electrical power for the electrically powered system; and the electrically powered system configured to utilize the electric power provided by the electrical generator while maintaining the electrical generator in an up-hole portion of the wellbore producing the electrical power, the electrical generator having a generator diameter that is greater than a downhole diameter of the downhole portion of the wellbore.

12. The high-voltage drilling system of claim 11, wherein the up-hole portion of the drill string includes one or more larger drill pipes coupled above the electrical generator, the larger drill pipes having a first diameter, and wherein the downhole portion of the drill string includes one or more smaller drill pipes coupled below the electrical generator, the smaller drill pipes having a second diameter less than the first diameter.

13. The high-voltage drilling system of claim 12, further comprising a turbine operably coupled to the electrical generator, and wherein at least one of the turbine, electrical generator or the one or more larger drill pipes defines the generator diameter.

14. The high-voltage drilling system of claim 13, further comprising at least one casing string circumscribing the turbine and electrical generator.

15. The high-voltage drilling system of claim 11, wherein the up-hole portion of the drill string includes at least one or more return ports through which a portion of a wellbore fluid flowing within the up-hole portion of the drill string may be discharged to an annulus surrounding the up-hole portion of the drill string.

16. The high-voltage drilling system of claim 11, wherein the downhole portion of the drill string includes at least one inner drill pipe nested within an outer drill pipe defining an annulus between the inner drill pipe and the outer drill pipe.

17. The high-voltage drilling system of claim 11, wherein the electrical conductor includes a solid metal rod extending through the downhole portion of the drill string.

18. The high-voltage drilling system of claim 11, further comprising an electrical transformer coupled between the electrical conductor and the electrically powered system, the electrical transformer carried by a bottom hole assembly.

19. The high-voltage drilling system of claim 18, wherein the bottom hole assembly further carries a capacitor bank and switches coupled between the electrical conductor and the electrically powered system.

20. The high-voltage drilling system of claim 11, wherein the electrically powered system includes a bottom hole assembly, the bottom hole assembly including one or more of a measurement while drilling (MWD) system, a drilling system, a logging while drilling (LWD) system, a telemetry system, and a pulse-power system.

* * * * *